US007954407B1

(12) United States Patent
Jenkins

(10) Patent No.: US 7,954,407 B1
(45) Date of Patent: Jun. 7, 2011

(54) STEEL RULE DIE AND STEEL RULE

(76) Inventor: Henry H. Jenkins, Medford, OR (US)

( * ) Notice: Subject to any disclaimer, the term of this patent is extended or adjusted under 35 U.S.C. 154(b) by 473 days.

(21) Appl. No.: 09/580,412

(22) Filed: May 30, 2000

(51) Int. Cl.
*B26F 1/46* (2006.01)

(52) U.S. Cl. ..... 83/652; 83/698.11; 83/699.11; 83/682

(58) Field of Classification Search ..... 83/699.11, 83/652, 653, 128, 901, 682, 683, 684, 685–687, 83/698.11; 76/107.8
See application file for complete search history.

(56) References Cited

U.S. PATENT DOCUMENTS

| | | | | | |
|---|---|---|---|---|---|
| 171,270 | A | * | 12/1875 | Dewes | 83/683 |
| 339,084 | A | * | 3/1886 | Butterworth | 83/682 |
| 1,177,005 | A | * | 3/1916 | Zimmerman | 83/652 |
| 1,635,964 | A | * | 7/1927 | Shinnick | 493/354 |
| 2,860,555 | A | * | 11/1958 | Williamson | 493/476 |
| 3,335,628 | A | * | 8/1967 | Simms et al. | 83/652 |
| 3,464,293 | A | * | 9/1969 | Schnorr et al. | 76/107.1 |
| 3,797,351 | A | * | 3/1974 | Jones, Jr. | 83/699.11 |
| 3,826,170 | A | * | 7/1974 | Jones et al. | 83/699.11 |
| 4,607,553 | A | * | 8/1986 | Hartzell | 83/684 |
| 4,921,154 | A | * | 5/1990 | Abe et al. | 76/107.8 |
| 4,938,105 | A | * | 7/1990 | Böswarth | 83/652 |
| 5,029,505 | A | * | 7/1991 | Holliday | 83/699.11 |
| 5,048,182 | A | * | 9/1991 | Robbins, III | 76/107.8 |
| 5,676,032 | A | * | 10/1997 | Johnson | 83/652 |
| 5,943,935 | A | * | 8/1999 | Brayton et al. | 76/107.8 |
| 6,085,625 | A | * | 7/2000 | Sandford | 76/107.8 |

* cited by examiner

*Primary Examiner* — Boyer D Ashley
*Assistant Examiner* — Omar Flores-Sánchez
(74) *Attorney, Agent, or Firm* — Woodling, Krost and Rust

(57) ABSTRACT

A steel rule die is disclosed which includes a bottom board with one or more cavity boards stacked on top of the bottom board. A metal plate is located on top of the uppermost cavity board. A top board is located on top of the metal plate. A plurality of rule slots are provided on the top board which define in plan view a generally rectangular or square configuration and a steel rule die is located in each of the slots. Each of the steel rules is generally flat to fit into a given slot and has a bottom portion adjacent the metal plate with a top portion formed into a cutting edge residing above the upper surface of the top board. Each of the steel rules extends on a longitudinal axis and has first and second end portions with the first end located approximately at a 45° angle to the longitudinal axis and one side of the same and the second end portion extending at approximately a 45° angle to the longitudinal axis and on another side of the axis. The steel rules in the rule slots are arranged alternately with the first end portion of a given rule located adjacent the second end portion of the next rule adjacent the given rule.

10 Claims, 9 Drawing Sheets

STEEL RULE DIE AND STEEL RULE

The present invention relates to what is commonly referred to as a steel rule die primarily designed for use in cutting material such as cardboard to shape or to a given form and which is, for example, used in the skin and blister packaging industry. In many instances a large sheet of cardboard has a plurality of identical products skin or blister packaged thereto and it is necessary to cut the plurality into a number of individual packages. The cardboard conventionally has printing or other indicia applied to the face thereof and in most instances has been coated with a polymeric material to which the skin packaging or blister packaging can be conveniently attached. The invention also relates to the steel rules used in the die.

In the skin and blister packaging industry the base material such as cardboard, with or without products blister or skin packaged thereto, are usually manufactured in sheets and then by means of a steel rule die are severed from the sheet resulting in discrete individual packages or cards. The substrate or cards upon which the product is attached are usually cut, depending upon the configuration of the steel rule die, into a card with square corners, rounded corners and in other instances with corners of other configurations. The problems involved with cards having square corners are that they are very easily damaged when they are subjected to a blow or other disturbance whereas the round corner cards or corners with other configurations are less susceptible to physical damage. Cards with physically damaged corners are much less attractive in appearance to the consuming public.

The manufacture of steel rule dies for the production of cards or other severed materials having square corners is relatively easy for die makers to make whereas the more desirable rounded corner configuration is much more difficult to construct. By this is meant that the steel rule die configuration to produce the rounded corner cards must be produced by a die maker who is extremely skilled and has substantial experience in configuring the steel rules physically so that the rounded corner configurations can be accomplished.

As a result of the requirement for extreme skill in the construction of the steel rule dies to produce the cards with rounded corners, they are extremely expensive and time consuming to produce and are structurally weak. For this construction, it is necessary for the manufacturer of the blister and skin package products to engage the services of a die maker who has substantial experience, skill and artistry in the art of making the steel rule die and then it is necessary for the manufacturer of the product to await the sometimes extensive time frame which is required for the die maker to complete the die construction.

The present invention has as one of its objects to provide a steel rule die construction which enables one with very little skill to construct a steel rule die of a given-configuration in a very short period of time and/or which enables a user of steel rule dies to essentially assemble steel rule dies from parts which are available off the shelf. In other words with the present invention it is relatively simple to assemble the dies and have them available for off the shelf supply or to provide them on an in stock basis.

The steel rule die of the present invention makes it relatively easy for a user who needs a steel rule die of a given configuration to simply assemble the die himself with a few off the shelf parts which will be described in more detail hereinafter.

The present invention also enables the owner or user of a steel rule die to easily repair the die in case some portion of the die becomes damaged because of either misuse, wear, or other unknown or unforeseen factors.

Another object of the present invention is to effect a cost reduction in the manufacture of steel rule dies for use in the industry as above described and other uses specifically described herein and as will be noted will make the steel rule dies available in a much shorter turnaround time and on a much more economical basis.

As will be noted hereinafter it will be possible for those desiring to assemble their own steel rule dies to buy kits accommodating or containing a minimum number of elements which can be utilized by the user for constructing his own steel rule dies in his own facility with other than extremely skilled workers.

It is contemplated that these kits to be supplied by the manufacturer of the components necessary to accommodate the present invention will include steel rule sections of a given length, sponge type rubber to be appropriately located relative to the steel rules to provide for the ejection of the cut cards or material from the normal sheets carrying a multiplicity of these cards as well as punches with ejection rubber and also ejection rubber for inside corner configurations as will be more fully described hereinafter in this application.

The present invention as discussed hereinabove has to do with a steel rule die construction with the above mentioned economies and efficiencies which provide and/or produce a card or substrate which is adapted to be used in connection with skin and blister packaging with corners which can be described as 45° corners on each corner thereof.

A still further object of the present invention is to provide a rule construction which includes a generally flat metal member with a cutting edge formed on one edge and with opposed end portions bent or formed at approximately a 45° angle to the extent of the metal member and in opposite directions.

Another object of the present invention is to provide a rule with opposite ends bent or formed in opposite 45° directions so a multiple of the rules can be arranged with opposite ends together to cut material such as cardboard with 45° corners.

Other objects and a fuller understanding of this invention may be had by referring to the following description and claims, taken in conjunction with the accompanying drawings, in which:

Figure 14:
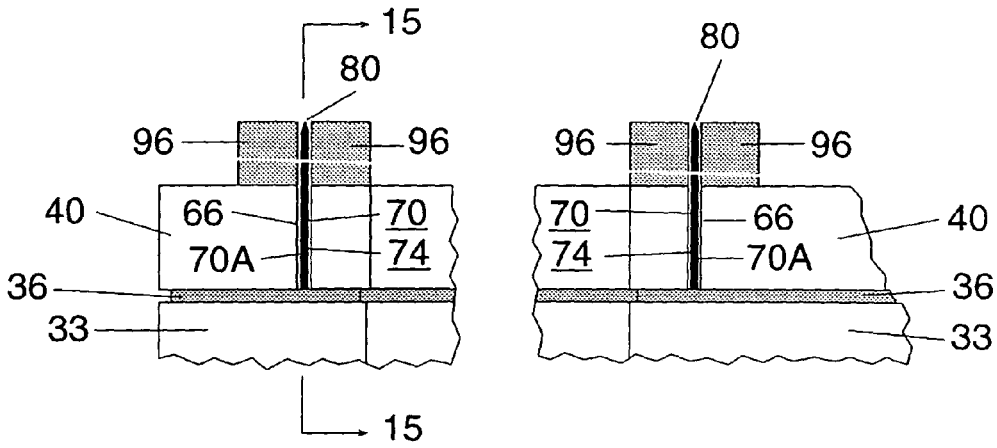
Figure 2:
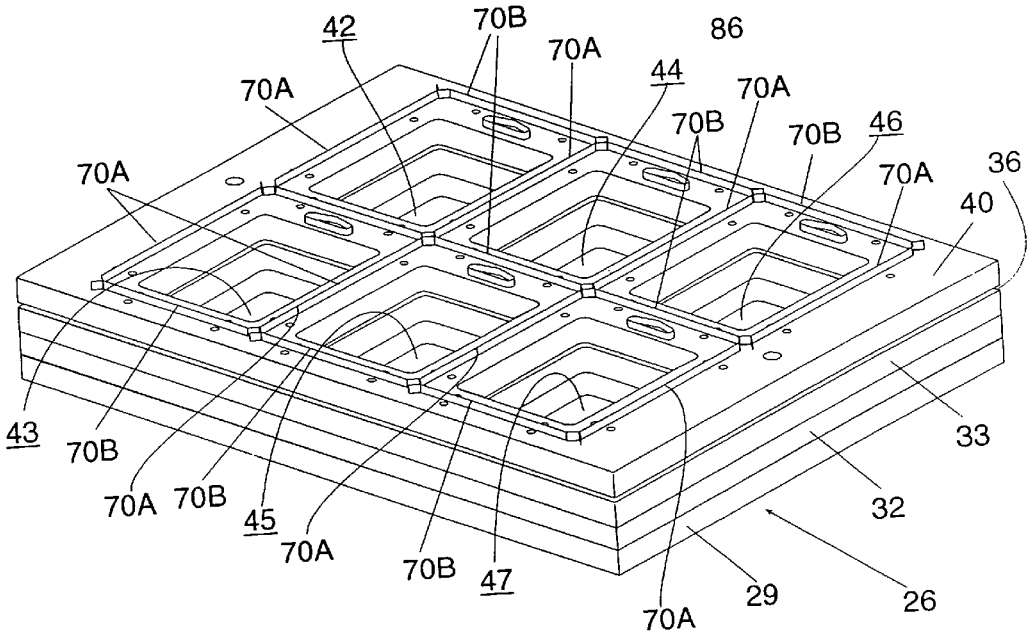
FIG. 2 is an isometric view illustrating a steel rule die constructed in accordance with the present invention.
Figure 3:
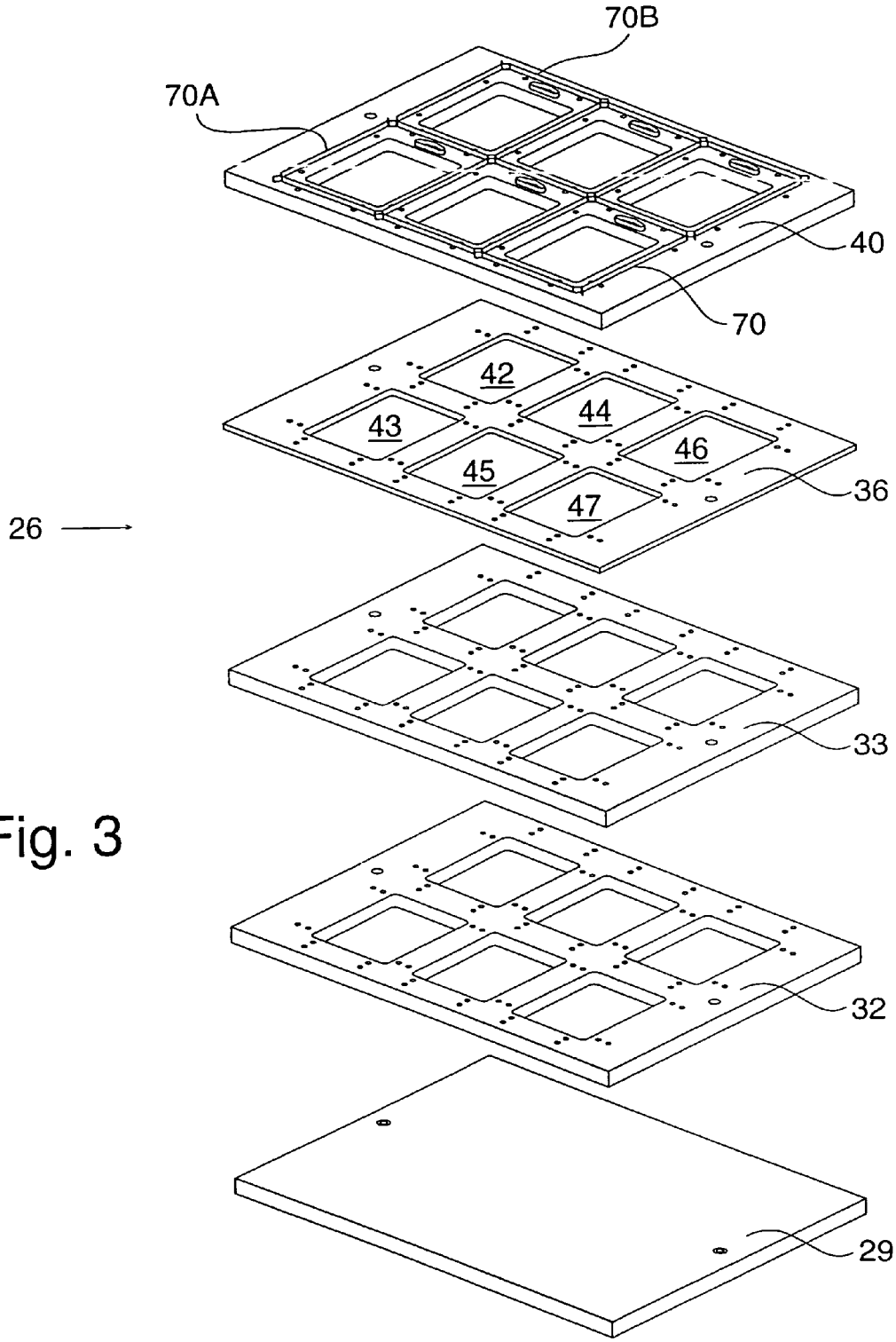
FIG. 3 is an exploded isometric view of the steel rule die shown in FIG. 2.
Figure 4:
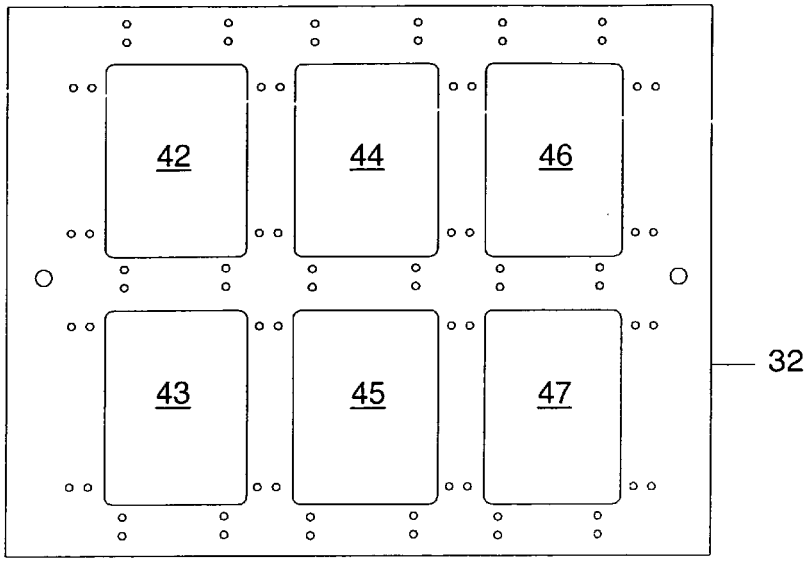
FIG. 4 is a plan view of a cavity die board illustrated in FIGS. 2 and 3 there being two identical boards in the FIGS. 2 and 3 construction.
Figure 15:
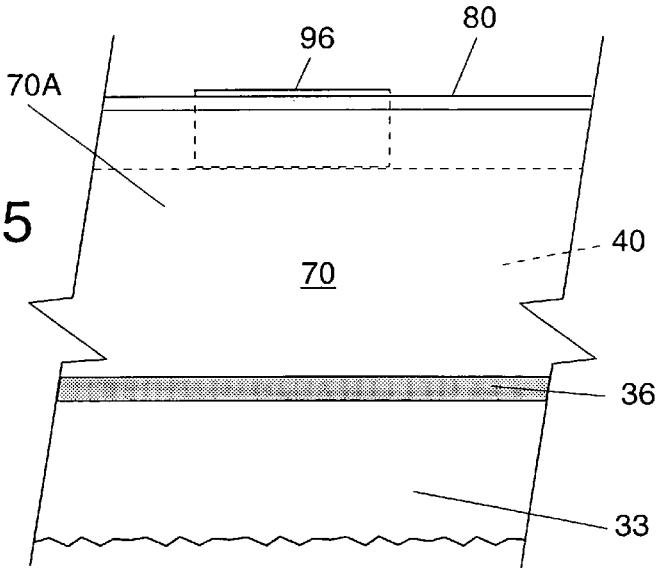
Figure 6:
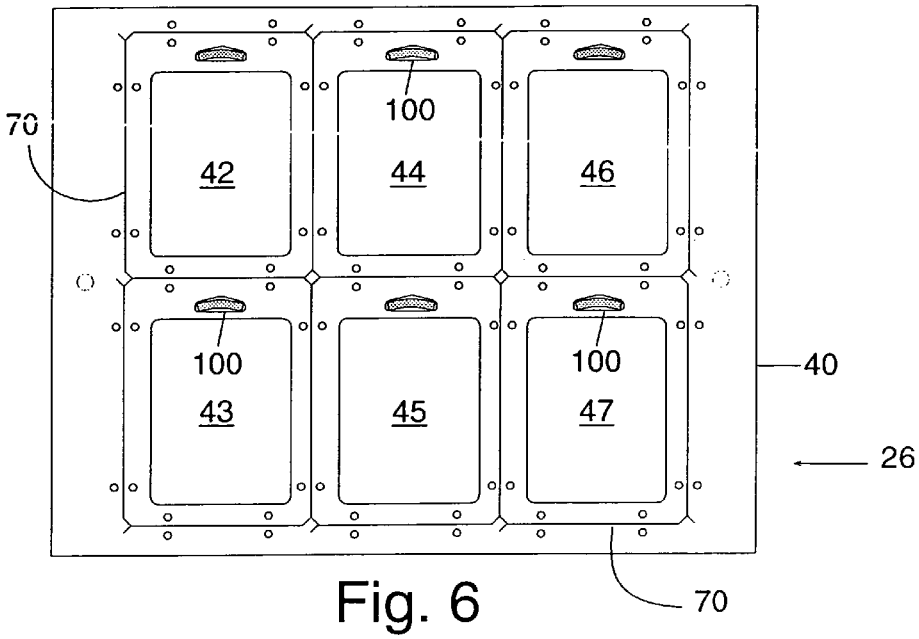
FIG. 6 is a plan view of the die illustrated in FIGS. 2 and 3.
Figure 5:
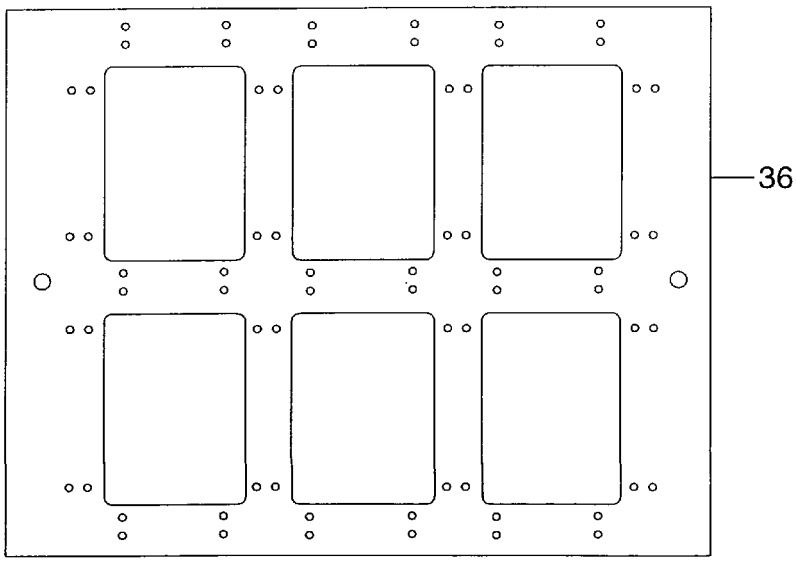
FIG. 5 is a plan view of a backing plate illustrated in FIGS. 2 and 3.
Figure 7:
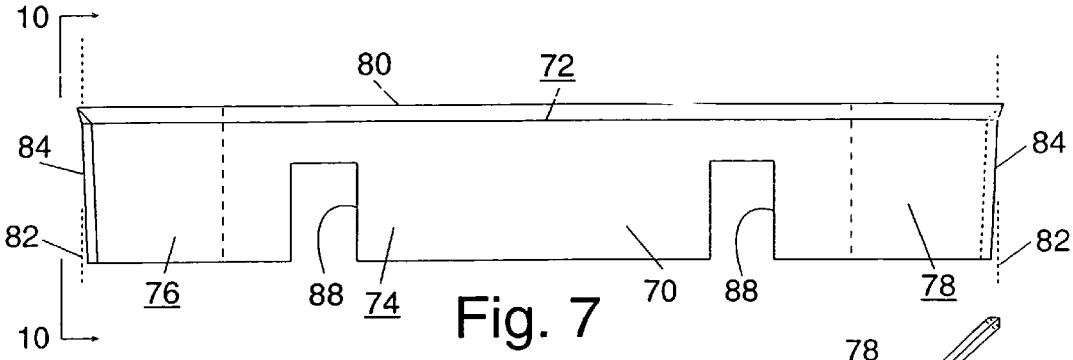
FIG. 7 is a side elevational view of the steel rule of the present invention taken generally along the line 7-7 of FIG. 8.
Figure 8:
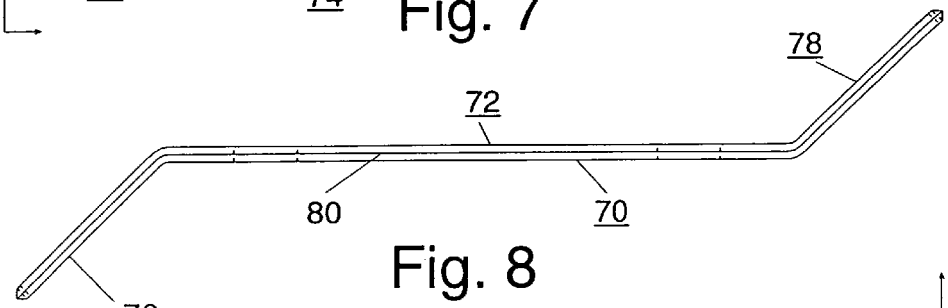
FIG. 8 is a plan view of the steel rule shown in FIG. 7.
Figure 9:
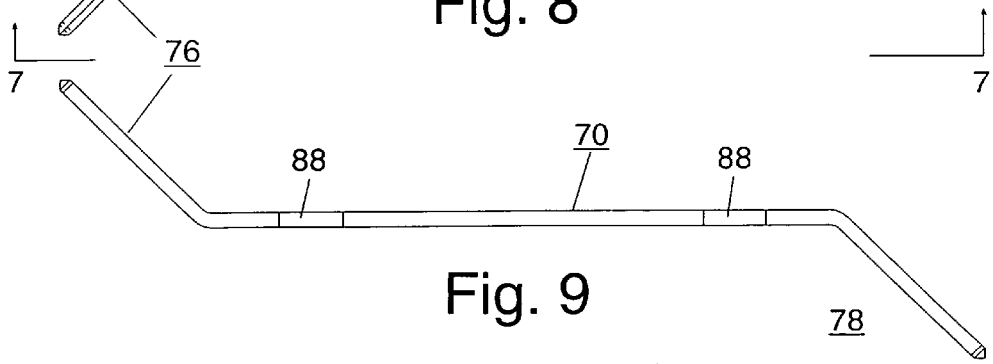
FIG. 9 is a bottom view of the steel rule shown in FIG. 7.
Figure 10:
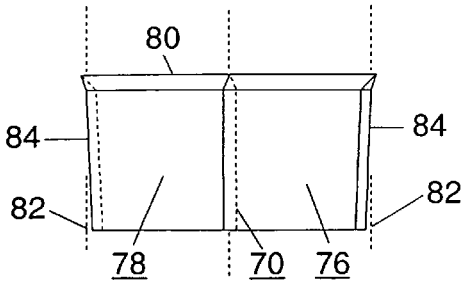
FIG. 10 is an end view of the steel rule die shown in FIG. 7 taken generally along the line 10-10 of FIG. 7.
Figure 13:
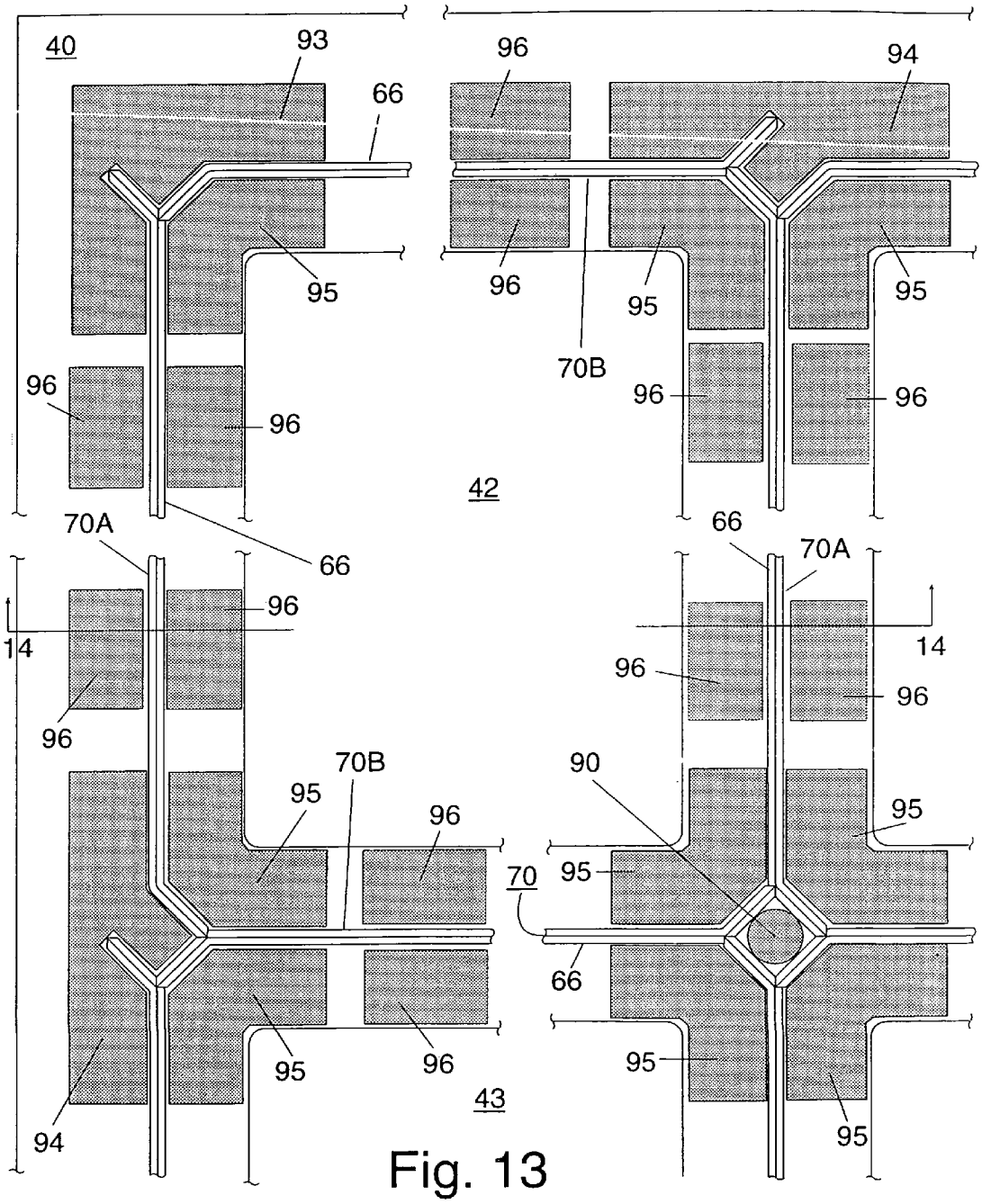
FIG. 13 is an enlarged fragmentary view of a portion of the steel rule die illustrated in FIG. 6 illustrating the ejection rubber which has been omitted from the other views of the steel rule die.

FIG. 14 is a fragmentary view taken generally the line 14-14 of FIG. 13 illustrating the positioning of a steel rule within the slots provided in the top board shown in FIGS. 2, 3 and 6 and showing the relative position of the steel rule relative to the backing plate and the ejection rubber illustrated in FIG. 13; and FIG. 15 is a view taken generally along the line 15-15 of FIG. 14 illustrating the bridges in the top board which assist in supporting the steel rules.

Figure 1:
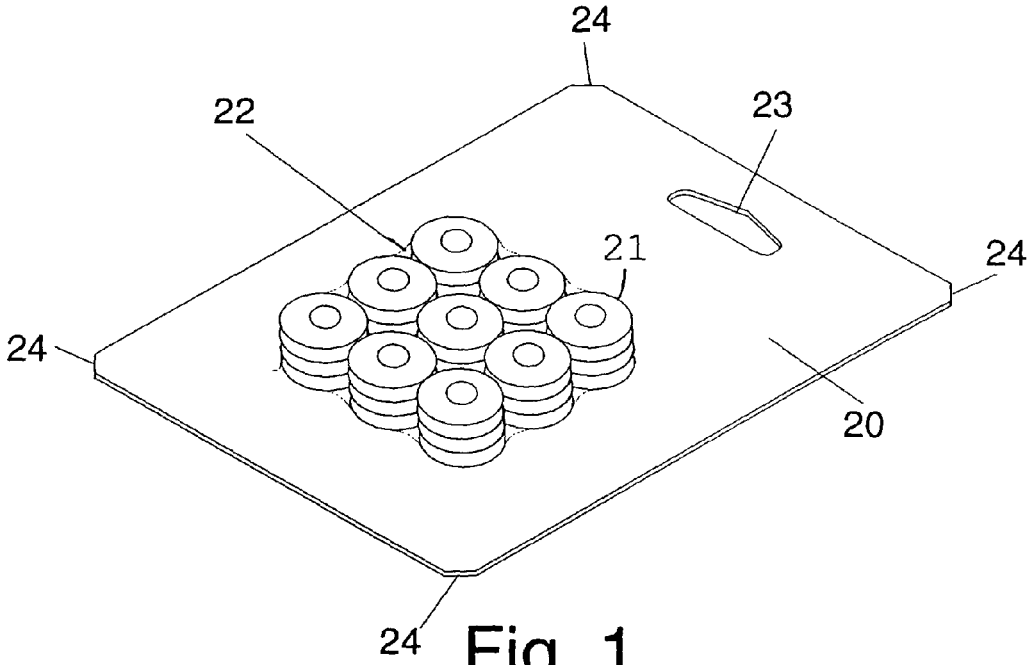
FIG. 1 is an isometric view of a card upon which has been skin packaged to carry a product and which illustrates the 45° corners produced by the steel rule die of the present invention.

The drawings illustrate an embodiment of the present invention and as seen in FIG. 1 there is illustrated a card 20 to which has been skin packaged 22 a product 21 to be illustrated for sale to the purchasing public. One of the primary uses of the invention is to cut cards to which products have been attached by skin packaging or by containment in a blister package. The card conventionally is adapted to contain advertising media or other indicia and as will be seen includes a hang hole 23 and has been formed with 45° corners all of which have been represented by the reference numeral 24. The provision of the 45° corner as discussed hereinabove is desired because it prevents damage to the card when the card is dropped onto another surface or otherwise physically abused and is much more desirable than a 90° corner which can be easily damaged. As pointed out hereinabove cards which are provided with a rounded corner are also advantageous from the standpoint of resisting physical abuse but the dies for producing such cards are extremely difficult and expensive to make requiring the services of a very skilled die maker and resulting in a product that cannot be readily and economically provided to the user of such product. The advantages of the present invention are brought about by the construction of a steel rule die which is illustrated in FIGS. 2 and 3 and which has been identified by the reference numeral 26. FIG. 2 simply illustrates the steel rule die in its assembled form with some portions omitted which will be readily understood from the explanation given hereinafter with FIG. 3 illustrating the steel rule die in an exploded isometric view.

The steel rule die includes a bottom board 29 and first and second cavity boards 32 and 33. These boards or any one of them may be referred to as a support board. A metal backup plate 36 is positioned between a top board 40 and the second cavity board 33. This sandwich of components or assembled condition of these components produces which for identification purposes are a plurality of cavities identified by the reference numerals 42-47. These cavities that are produced are for the purpose of accommodating a sheet of material such as cardboard which carries thereon a plurality of still connected cards 20 which have been identified in FIG. 1, for example 6 in these illustrations, and the steel rule die 26 is designed to sever these connected cards 20 in a cutting operation. In this cutting operation, the sheet is positioned over the top of the top board 40 with the skin packaged product 21 accommodated in the cavities 42-47 which provides a clearance for these blisters. When the steel rule die is brought up into engagement with a platen of a hydraulic press (not illustrated) or when the platen is brought down into engagement with the sheet carrying the plurality of cards 20 they will be cut into individual cards, in this case 6 in number, to provide six such separated cards. The cavities 42-47 are simply for the purpose of providing an unobstructed location for the skin packaged product 21.

It will be well appreciated by those skilled in the art that in many instances the steel rule die may be utilized simply to cut flat material into a plurality of desired configurations and in those circumstances the necessity of using the cavity boards 32 and 33 will be obviated. In those circumstances it would be usual to utilize a bottom board 29, a backup plate 36 and a top board 40 or essentially their equivalent. In this type of operation one is utilizing primarily the top board 40 with its associated components and a metal backup plate 36. In some constructions it is possible to simply locate a metal strip over the bottom of the slot that accommodates the rules which will support the rules in position.

The top board 40 is provided with a plurality of rule slots all of which have been identified by the reference numeral 66 (see FIG. 14) which receive and support steel rules 70. The illustrations in the accompanying drawings utilize rules of two different lengths 70A and 70B. This will accommodate the desired rectangular shapes and when one desires a square configuration only one length is needed. To differentiate these different length rules the longer rules have been identified by the reference numeral 70A and the shorter rules have been identified by the reference numeral 70B. There are thus illustrated in the die of FIG. 2 and FIG. 3 eight of the longer rules 70A and nine of the shorter rules 70B to complete the configuration of a die construction which will sever a sheet of material into six identical cards.

FIGS. 7-10 and 12 show the steel rule 70 in more detail. The steel rule 70 normally starts out as a flat piece of steel which is approximately 0.040-0.042" in thickness. However, it is not limited to this thickness for performing its intended function. A three point rule which is illustrated herein is on the order of 0.937" high. The steel rule has, for identification purposes, an upper edge portion 72, a lower edge portion 74 and first and second end portions 76 and 78, respectively. The upper edge portion 72 is provided with a cutting edge 80 thereon which in cross-sectional configuration appears triangular in shape. A plurality of clearance slots 88 are formed in the rule 70 extending from the lower edge portion up into the body of the metal member. These slots are for the purpose of straddling bridges formed in the rule slots 66 out of the wood, for example, of the top board 40. In other words, the rule slots are discontinuous for a distance for support and this distance is slightly less than the length of slots 88. FIG. 14 and FIG. 15 illustrate the location of a rule 70 in a rule slot 66. The terminating end or edge of the each end portion of each rule 70 is provided with a terminating edge 84. This terminating end or edge 84 is best illustrated in the enlarged view of FIG. 12 which shows the engagement of the terminating end 84 of opposite ends of a rule 70A with a shorter rule 70B. This terminating end or edge 84 as will be noted in both FIGS. 10 and 12 extends at a slight angle to the vertical which is a construction which assures that the engaging portions of the cutting edge 80 of mating rules 70A and 70B will clearly engage at this point so as not to provide a discontinuity in the cutting edge. This slight angle is illustrated by reference to vertical reference lines in FIG. 10

Figure 11:
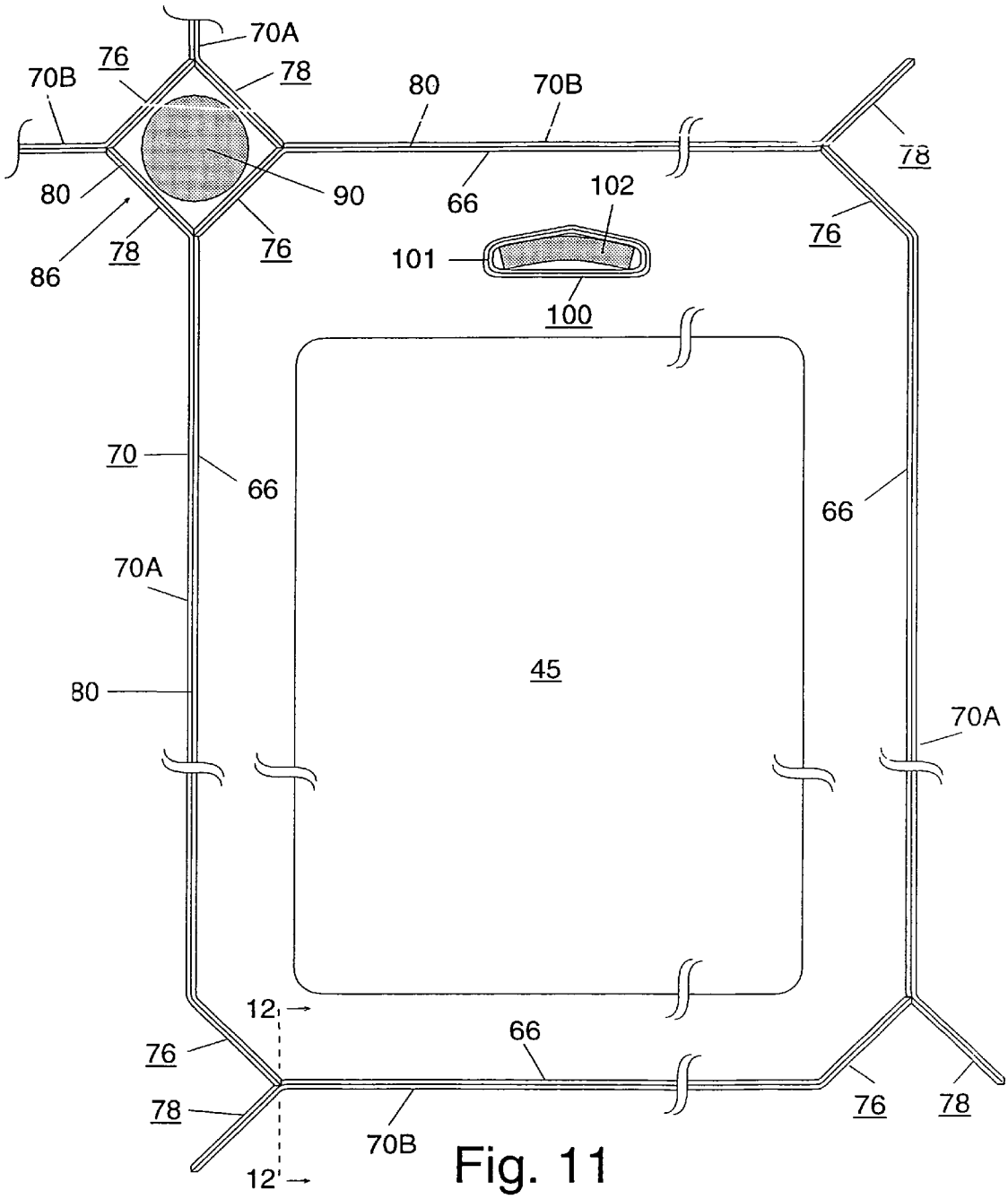
FIG. 11 is an enlarged view of a portion of the die shown in FIG. 6.
Figure 12:
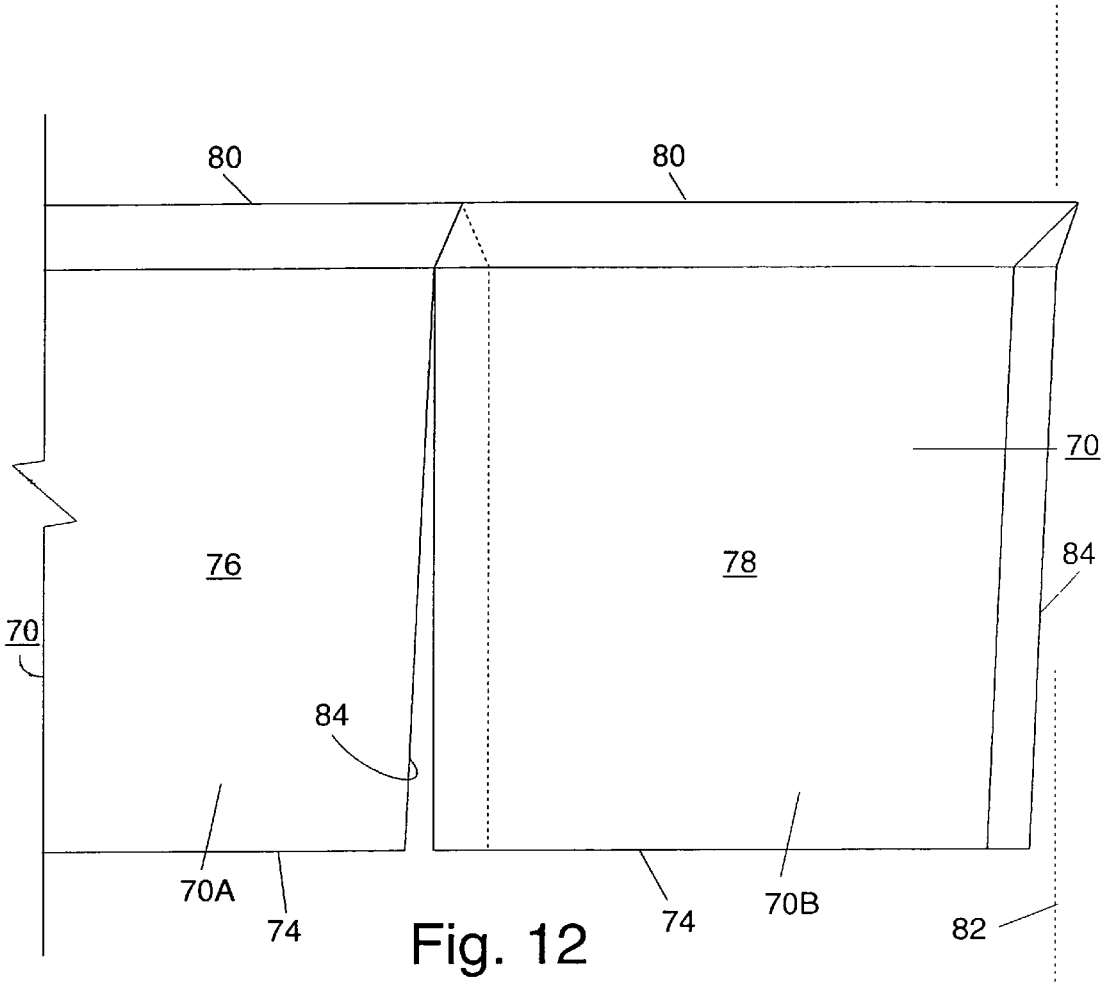
FIG. 12 is an enlarged view taken generally along the line 12-12 of FIG. 11 illustrating the interconnection between two rules which are used in the steel rule die of the present invention.

FIG. 11 illustrates the configuration of a plurality of steel rules 70A and 70B in forming for example the cavity 45 identified in FIG. 2. In this view of FIG. 11 there is illustrated steel rule 70A engaging steel rule 70B for example in the lower left hand corner of the view. This illustrates how the first end portion 76 of rule 70A comes into engagement with the second end portion 78 of rule 70B. It will be noted in FIG. 11, for example, that where rule 70A meets 70B at line 12-12 where FIG. 12 is taken that the first end portion 76 engages to form a 45° angled corner. The essential difference in these two rules is their length. The cross sectional view of FIG. 12 illustrates in enlarged form this mating engagement so as to provide a continuous cutting edge between the two rules 70A and 70B. In like fashion, the other portions of additional rules 70A and 70B engage as indicated to form a rectangular configured cutting edge which produces a cut card having 45° corners. It will also be seen in FIG. 11 how the rules 70A and 70B come together to form a so-called inside corner generally identified and represented by the reference numeral 86 (see upper left hand corner of FIG. 11). It will be noted that this inside corner is formed by the indicated end portions of the steel rule dies 70A and 70B forming a generally rectangular configuration essentially square in its measurements. To insure that when the cutting operation performed by the steel rule die is completed that the square piece of cardboard or material formed at this position is removed and does not remain in this rectangular space, a cylindrically shaped ejection rubber 90 is provided in the square configuration which is made of relatively firm and high durometer rubber. This rubber extends slightly above the level of the cutting edge 80 of the rules and is compressed vertically into the square configuration during cutting causing the rubber 90 to expand generally to the square configuration. When the cutting operation is completed this ejection rubber 90 assumes its unstressed condition and removes the square cut piece of cardboard so it does not stay in or remain in the square configuration of the inside corner 86. It will be noted in the die illustrated in FIG. 2 there are two inside corners for the construction and ejection rubber 90 is provided in each of these two inside corner configurations.

FIG. 13 illustrates the configuration of rules 70A and 70B to form the cavity 42 and similar cavities illustrated in FIG. 2. This view is for the purpose of illustrating the configuration of various pieces of ejection rubber and their location about the perimeter of the cutting edges of the steel rule die. There is identified in FIG. 13 four configurations of ejection rubber identified by the reference numerals 93, 94, 95 and 96. These pieces of ejection rubber 93-96 are configured as illustrated and are appropriately positioned around strategic locations of the steel rules so as to appropriately eject pieces of material such as cardboard after they are cut from an integral sheet. These pieces of ejection rubber are made of a soft spongelike rubber material unlike the relatively hard ejection material of member 90. The tops of these ejection rubbers 93-96 are located slightly above the cutting edge of the steel rule in their unstressed condition as illustrated in FIG. 14.

FIG. 14 which is a view taken generally along the line 14-14 of FIG. 13 is presented to illustrate the relative position of the rules 70 in the rule slots 66 that are provided in the top board 40 of the construction. It will be seen that the cutting edge extends above the upper surface of the top board and the rules 70 are confined and supported within the rule slots 66. The cutting edge 80 of the rule extends to a vertical position slightly below the ejection rubber 93-96. The lower edge portion 74 of the rules is adapted to engage the metal backup plate 36 which in this construction rests on the cavity board 33 so that when the cutting operation is performed the force required to perform the cutting operation will not cause the rules to move out of position.

FIG. 15 is a view taken generally along the line 15-15 of FIG. 14 and shows the steel rule in the rule slot 66. These bridges as discussed above are simply material of the top board 48 which has not been removed when constructing the rule slot 66. These bridges and the rule slots keep the rules 70 firmly positioned in the configurations illustrated in the accompanying figures and particularly hold the rules in position so that the first end portion of a rule 70 appropriately engages the second end portion of an adjacent rule to form the 45° corner of the construction.

The drawings (see FIG. 11) also illustrate the construction of punches 100 which are for the purpose of producing the hang holes 23 in the cards. These punches include a steel rule 101 formed in a generally oval shape within which is confined an ejection rubber 102 which functions in a manner similar to ejection rubber 90 in that when the hang hole is cut in a cutting operation the portion of the card removed is reliably and forcibly ejected and is not confined within the generally elliptical configuration of the steel rule 101. The ejection rubber 102 is generally of the same durometer hardness as ejection rubber 90 for example on the order of 60 shore durometer and reliably ejects the hang hole portion of the card.

The manufacture and construction of the steel rule die disclosed and claimed herein will be generally apparent to those skilled in the art. However, a discussion of the methodology of producing the construction will be given hereinafter.

As a general proposition the top board 40 which may be generally of a plywood construction is laid out in that the rule slots 66, the cavity (42-47) location lines, and the punch (100) shapes as well as various hole locations for producing the configurations are located. Holes are drilled to define the bridges, the corner clearance holes, the punch holes, and the corners which define cavities 42-47. With these holes drilled in the board 40, access is provided for a saw to cut the punch holes, the cavity shapes as well as rule slots. Holes (unnumbered) are provided in boards 29, 32, 33 and 40 as well as plate 36 so these elements can be conveniently secured together by fasteners, not illustrated. The rules 70A and 70B are placed in the slots and are tapped into position by means of a hammer or other device to position the rules as illustrated. The punches 100 with ejection rubber 102 are put in position as well as the ejection rubber 90 in the interior corners and the ejection rubber 93-96 as illustrated. The ejection rubber 93-96 is attached normally by glue and is positioned for example 1/16" above the cutting edge of the steel rule. The same is true of ejection rubber 102.

Once the die has been completed as illustrated in FIGS. 2 and 3, it is then ready for use. Conventionally the die is placed on the platen of a die cutting press such as with a hydraulically actuated ram which will move the steel rule die in a direction to perform the cutting operation. A cardboard carrying, for the purposes of this example, six identical skin packaged products as illustrated in FIG. 1 or blister packaged (not illustrated) is placed on the steel rule die with the products occupying the spaces provided by the cavities 42-47. The platen upon which the steel rule die is located is actuated to move toward a planar surface to cause the integral card carrying a plurality of the products thereon to be cut into the six identical configurations by the cutting edge 80 of the steel rules being forced through the card against the planar surface of the press.

Once the cutting operation has been completed, the die is moved away and the ejection rubbers 90, 93-96 and 102 eject the cut pieces from the cutting edge of the steel rule resulting in the desired separation of the cards 20.

It will thus been seen that the above referred to disclosed invention discloses a rule construction preferably of steel or other equivalent metal material which can be readily used in arranging a plurality of the rules to produce a die for cutting cardboard into rectangular or square configurations having 45° corners which corners are more difficult to damage than those which are produced which have 90° corners.

The rules of the present invention are the same in their end configurations and may have varied desired lengths to provide appropriate rectangular or square configurations for cutting cardboard and which are easy to put together to manufacture a steel rule die.

Kits can be prepared for sale to users who desire steel rule die constructions and with the steel rule construction of the present invention users can readily assemble their own dies without the aid of an extremely skilled die maker which is the case when dies are desired to produce substrates with rounded corners.

It is also possible for a manufacturer who has a steel rule die utilizing the steel rules of the present invention to repair a die which has been damaged for any of many reasons, for example, the damaging of one portion of a rule, the damaging of any of the boards, ie., the top board, cavity board, or bottom boards of the present invention without the necessity of engaging an extremely expensive die maker and can accomplish this by use of parts which are in effect off the shelf.

Although this invention has been described in its preferred form with a certain degree of particularity, it is understood that the present disclosure of the preferred form has been made only by way of example and that numerous changes in the detail of construction and the combination and arrangement of parts may be resorted to without departing from the spirit and the scope of the invention as hereinafter claimed.

What is claimed is:

1. A steel rule die including in combination
a bottom board,
one or more cavity boards on top of said bottom board,
a metal plate located on top of said top cavity board,
a top board located on top of said metal plate,
a plurality of rule slots in said top board defining in plan view a rectangular or square configuration,
a steel rule in each of said slots,
each of said steel rules being generally flat to fit in a slot and having a bottom portion adjacent said metal plate and a top portion formed into a cutting edge residing above the surface of said top board,
each said steel rule extending on a longitudinal axis and having first and second and portions,
said first end portion extending at approximately a 45° angle to said longitudinal axis and on one side of said axis,
said second end portion extending at approximately a 45° angle to said longitudinal axis and on another side of said axis,
said steel rules in said rule slots being arranged alternately with said first end portion of a given rule located adjacent said second end portion of a next rule adjacent said given rule.

2. A steel rule die as claimed in claim 1 wherein the end portions of four steel rules meet to define an inside corner which is generally square in configuration, a generally cylindrical ejection rubber located within said square configuration to eject material cut by the cutting edges of the meeting steel rules.

3. A steel rule die as claimed in claim 1 wherein ejection rubber is positioned on opposite sides of said steel rules to eject material cut by the cutting edges of said steel rules.

4. A steel rule as claimed in claim 1 wherein said cutting edge is defined by a generally triangular shaped configuration.

5. A steel rule die as claimed in claim 4 wherein the terminating end of each of said first and second end portions of said steel rule is formed on an angle to the vertical whereby the cutting edge thereat extends axial a greater distance than other portions of the terminating end.

6. A steel rule die as claimed in claim 5 wherein slots are formed extending from said bottom portion into said steel rule to support said steel rule.

7. A steel rule die including in combination
a metal plate,
a top board located on top of said metal plate,
a plurality of rule slots in said top board,
a steel rule in said slots,
each of said steel rules being generally flat to fit in a slot and having a bottom portion adjacent said metal plate and a top portion formed into a cutting edge residing above the surface of said top board,
each said steel rule extending on a longitudinal axis and having first and second end portions,
said first end portion extending at approximately a 45° angle to said longitudinal axis and on one side of said axis,
said second end portion extending at approximately a 45° angle to said longitudinal axis and on another side of said axis,
said steel rules in said rule slots being arranged alternately with said first end portion of a given rule located adjacent said second end portion of a next rule adjacent said given rule.

8. A steel rule as claimed in claim 7 wherein said cutting edge is defined by a generally triangular shaped configuration.

9. A steel rule die as claimed in claim 8 wherein the terminating end of each of said first and second end portions of said steel rule is formed on an angle to the vertical whereby the cutting edge thereat extends axially a greater distance than other portions of the terminating end.

10. A steel-rule die as claimed in claim 9 wherein slots are formed extending from said bottom position into said steel rule to support said steel rule.

* * * * *